US006791038B1

(12) United States Patent
Lai

(10) Patent No.: US 6,791,038 B1
(45) Date of Patent: Sep. 14, 2004

(54) ELECTRICAL SWITCH

(75) Inventor: Chi Leung Lai, Hong Kong (HK)

(73) Assignee: Defond Components Limited, Chaiwan (HK)

( * ) Notice: Subject to any disclaimer, the term of this patent is extended or adjusted under 35 U.S.C. 154(b) by 0 days.

(21) Appl. No.: 10/720,201

(22) Filed: Nov. 25, 2003

(51) Int. Cl.[7] ..... H01H 13/00

(52) U.S. Cl. ..... 200/16 A; 200/520; 200/529; 200/534; 200/341

(58) Field of Search ..... 200/520, 529, 200/530, 534, 1 B, 6 R, 16 R, 16 A, 16 B, 16 C, 48 R, 48 A–48 CB, 341; 361/709

(56) References Cited

U.S. PATENT DOCUMENTS 3,040,142 A * 6/1962 Dietrich et al. ..... 335/126
4,634,819 A * 1/1987 Ikeda ..... 200/16 A
5,075,517 A * 12/1991 Spanio ..... 200/16 A
6,605,792 B2 * 8/2003 Sato ..... 200/524

* cited by examiner

*Primary Examiner*—Michael A. Friedhofer
(74) *Attorney, Agent, or Firm*—Leydig, Voit & Mayer, Ltd.

(57) ABSTRACT

An electrical switch includes a casing, first and second fixed contacts, and a moving contact lever having first and second parts for contact with the first and second fixed contacts, respectively. A spring resiliently biasses the lever into contact with both of the first and second fixed contacts. There is also a pushbutton movable between first and second positions to cause the lever to move into contact with and out of contact from the fixed contacts, respectively. The pushbutton and spring act upon the lever at respective positions that are offset from each other. The lever is pivotable by the pushbutton in one direction to separate the first part from the first fixed contact and, subsequently, in an opposite direction to separate the second part from the second fixed contact.

14 Claims, 2 Drawing Sheets

ELECTRICAL SWITCH

The present invention relates to an electrical switch.

BACKGROUND OF THE INVENTION

The invention is particularly but not exclusively concerned with a normally-closed pushbutton switch. Electrical switches of this type are in abundant use, in which a separate moving contact may have opposite parts for contact with respective fixed contacts as two contact points. The contact point that is first to make and last to break is subject to contact arcing and flashover, especially for heavy current application, but it is often uncertain as to which one of the contact points will take the brunt, or a relatively complicated mechanism is needed.

The subject invention seeks to mitigate or at least alleviate such a shortcoming by providing an improved electrical switch.

SUMMARY OF THE INVENTION

According to the invention, there is provided an electrical switch comprising a casing, first and second fixed contacts, and a moving contact having first and second parts for contact with the first and second fixed contacts respectively. A spring is included to resiliently bias the moving contact into contact with both fixed contacts. There is also an operating member supported by the casing for movement between first and second positions to cause the moving contact to move into contact with and out of contact from the fixed contacts respectively. The operating member and the spring act upon the moving contact at respective positions that are offset from each other. The moving contact is pivotable by the operating member in one direction to separate its first part from the first fixed contact and subsequently in an opposite direction to also separate its second part from the second fixed contact.

Preferably, the casing includes a support for engagement by the first part of the moving contact to enable the moving contact to pivot in said opposite direction.

More preferably, the support is situated on one side of the first part of the moving contact opposite a part of the first fixed contact with which the first moving contact part is to make contact.

More preferably, the support comprises a heat sink.

In a preferred embodiment, the operating member and the spring act upon the moving contact along respective substantially co-parallel axes that are offset from each other.

In a specific construction, the moving contact comprises a lever having opposite ends as its first and second parts.

As an example, the spring comprises a compression coil spring.

It is preferred that the operating member includes a spring engaging the moving contact.

As an example, the operating member comprises a pushbutton.

Preferably, the aforesaid electrical switch is a normally-closed switch in which upon release of the operating member the moving contact is biassed into contact with both fixed contacts.

BRIEF DESCRIPTION OF DRAWINGS

The invention will now be more particularly described, by way of example only, with reference to the accompanying drawings, in which.

DETAILED DESCRIPTION OF PREFERRED EMBODIMENT

Figure 1:
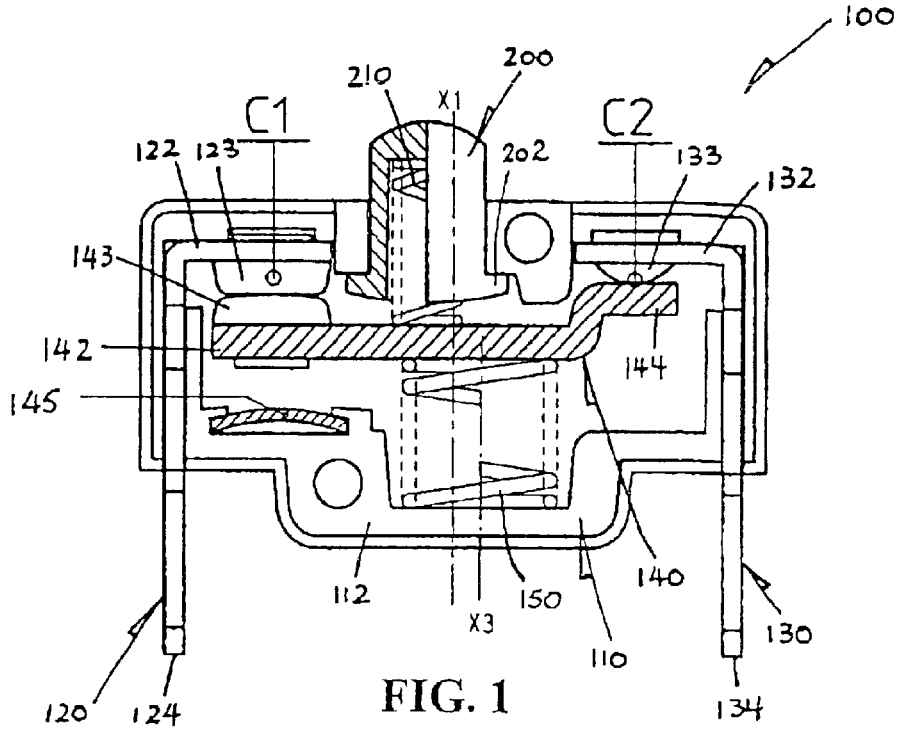
FIG. 1 is a cross-sectional side view of an embodiment of an electrical switch in accordance with the invention, said switch being in a normally-closed condition.

Referring to the drawings, there is shown an electrical switch embodying the invention, which is a pushbutton switch 100 having an oblong rectangular plastic casing 110, a pair of left and right fixed contacts 120 and 130, a moving contact lever 140 and an operating knob or pushbutton 200. The fixed contacts 120 and 130 are located at opposite ends of the casing 110, symmetrically about a central vertical axis Xl of the casing 110. Each fixed contact 120/130 is provided by a contact strip having an 90°-bent inner upper end 122/132 bearing a contact pad 123/133 and including a straight lower end 124/134 projecting downwardly out of the casing 110.

The contact lever 140 is placed centrally inside the casing 110 about the axis X1. While bridging horizontally across the fixed contacts 120 and 130, the lever 140 has its opposite left and right ends 142 and 144 normally in contact from below with the corresponding contact pads 123 and 133, whereby the switch 100 is normally-closed.

Figure 4:
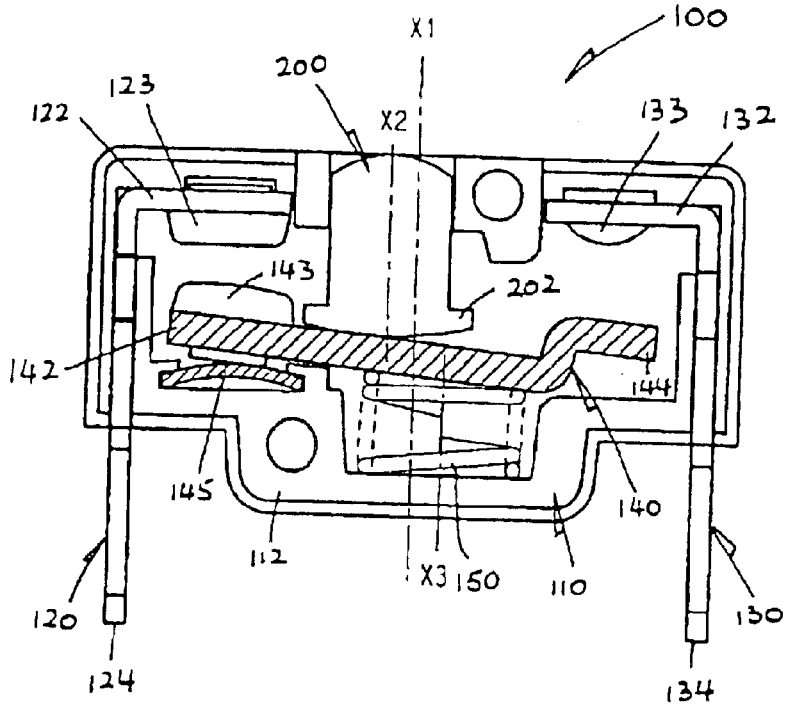
FIG. 4 is a cross-sectional side view corresponding to FIG. 3, showing the moving contact lever disconnecting from another fixed contact upon yet further depression of the operating member.

The pushbutton 200 is supported partially within the casing 110 between the fixed contact pads 123 and 133 and above the contact lever 140, for depression and release to move vertically between an uppermost position (FIG. 1) and a lowermost position (FIG. 4). The pushbutton 200 is positioned such that its vertical central axis X2 is offset slightly to the left of the casing axis X1, along which axis X2 the pushbutton 200 acts upon the lever 140.

The pushbutton 200 contains a small vertical compression coil spring 210 that projects slightly out of a bottom 202 of the pushbutton 200 and bears against the upper surface of the contact lever 140 so that the pushbutton 200 is biassed towards its uppermost position. With its bottom 202 expanded for engaging the relevant casing opening, the pushbutton 200 is anchored with casing 110. Upon depression of the pushbutton 200, its bottom 202 hits and pushes the lever 140 downwardly away from both fixed contacts 120 and 130.

The contact lever 140 is resiliently supported on its lower surface by another vertical compression coil spring 150 that is considerably stronger than the pushbutton spring 210. The contact spring 150 co-acts between the lever 140 and a bottom wall 112 of the casing 110, thereby biassing the lever 140 upwardly to urge its two ends 142 and 144 against the corresponding fixed contact pads 123 and 133. The spring 150 is positioned such that its vertical central axis X3 is offset slightly to the right of the casing axis X1, along which axis X3 the spring 150 acts upon the lever 140.

The left lever end 142 is fitted with a contact pad 143 for contacting the left fixed contact pad 123, together referred to as principal contact point C1. A metal plate is situated directly below the contact pad 143 on one side thereof opposite the left fixed contact pad 123, acting as a heat sink 145 for the contact pad 143. The right lever end 144 is bare for direct contact with the right fixed contact pad 143, together referred to as auxiliary contact point C2. The pushbutton 200 and the contact spring 150 are horizontally offset from each other, with their axes X2 and X3 on opposite left and right sides of the casing axis X1.

Figure 2:
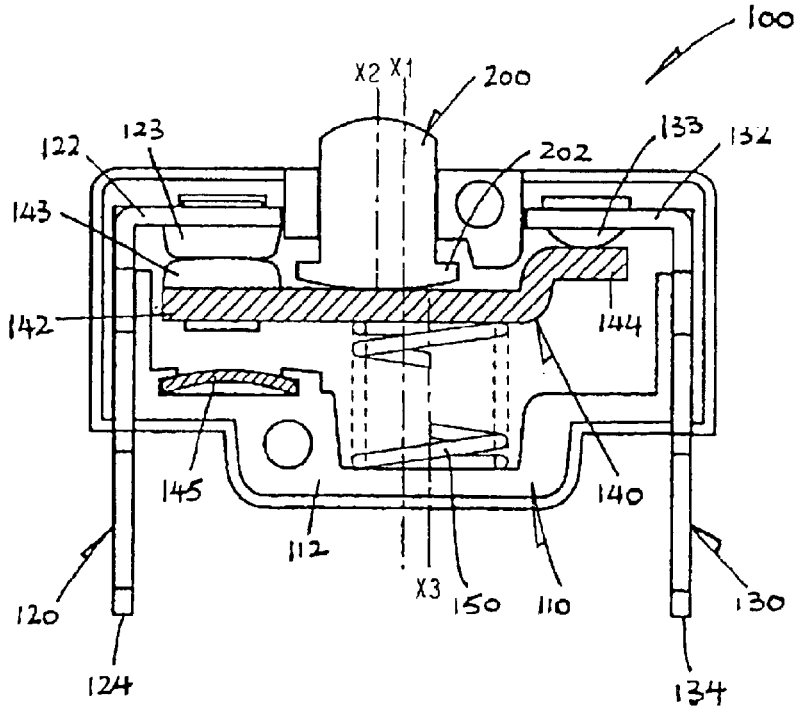
FIG. 2 is a cross-sectional side view corresponding to FIG. 1, showing an operating member of the switch being initially depressed.
Figure 3:
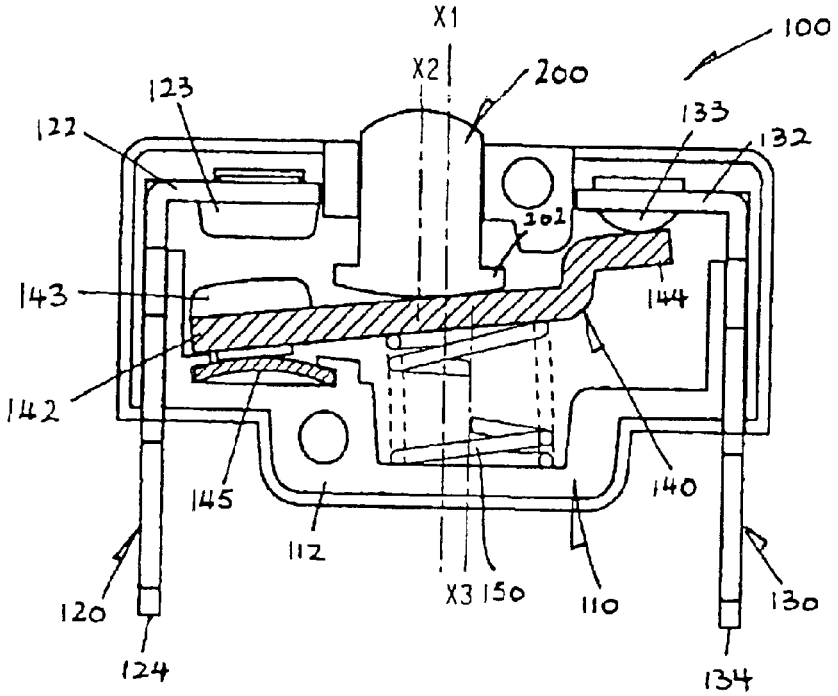
FIG. 3 is a cross-sectional side view corresponding to FIG. 2, showing a moving contact lever of the switch disconnecting from one fixed contact upon further depression of the operating member.

The operation of the switch 100 is now described. Being situated to the left of the spring 150, the pushbutton 200 will upon depression initially pivot the lever 140 anti-clockwise about the right fixed contact pad 133, thereby resulting in breaking of the principal contact point C1 while the auxiliary contact point C2 remains intact (FIGS. 1 to 3). Upon its contact pad 143 hitting and engaging the heat sink 145 and thus being supported thereby, the lever 140 can now only pivot in the opposite clockwise direction about the heat sink 145, thereby resulting in also breaking of the auxiliary contact point C2 (FIG. 4). As soon as the pushbutton 200 is released, the lever 140 is instantly returned by the spring 150 through pivotal actions in the reverse order as can be visualized from FIGS. 4 to 1.

As the principal contact point C1 is first to break and last to make, both contact pads 123 and 143 are well made to withstand contact arcing and flashover especially for heavy current application and the heat sink 145 is deployed to dissipate the heat of the contact pad 143. For this reason, no arcing or flashover will occur at the auxiliary contact point C2. The lever 140 is not permanently connected to the right fixed contact 130 (for flexing thereabout), and this allows the lever 140 to be made of a material (e.g. conductivity) and/or in a design (e.g. thickness) not compromised by other characteristics such as flexibility and workability.

The described switch 100 is a single-pole single-throw switch designed for use to provide a cool shot function in an electric hairdryer. It is envisaged that the subject invention may be applied to any other types of electrical switches, such as slide switches and rotary switches.

The invention has been given by way of example only, and various modifications and/or variations to the described embodiment may be made by persons skilled in the art without departing from the scope of the invention as specified in the accompanying claims.

What is claimed is:

1. An electrical switch comprising:

a casing, first and second fixed contacts, a moving contact having first and second parts for contact with the first and second fixed contacts, respectively, a first spring resiliently biassing the moving contact into contact with both of the first and second fixed contacts, and an operating member supported by the casing for movement between first and second positions to cause the moving contact to move into contact with and out of contact from the first and second fixed contacts, respectively, wherein the operating member and the spring act upon the moving contact at respective positions that are offset from each other, and the moving contact is pivotable by movement of the operating member in a first direction to separate the first part from the first fixed contact and, subsequently, in a second direction, opposite the first direction, to separate the second part from the second fixed contact, wherein the casing includes a support for engagement by the first part of the moving contact to enable the moving contact to pivot in the second direction.

2. The electrical switch as claimed in claim 1, wherein the support is situated on one side of the first part of the moving contact, opposite a part of the first fixed contact with which the first part of the moving contact is to make contact.

3. The electrical switch as claimed in claim 2, wherein the support comprises a heat sink.

4. The electrical switch as claimed in claim 2, wherein the operating member and the first spring act upon the moving contact along respective, substantially parallel axes that are offset from each other.

5. The electrical switch as claimed in claim 2, wherein the moving contact comprises a lever having opposite ends as the first and second parts.

6. The electrical switch as claimed in claim 1, wherein the support comprises a heat sink.

7. The electrical switch as claimed in claim 6, wherein the operating member and the first spring act upon the moving contact along respective, substantially parallel axes that are offset from each other.

8. The electrical switch as claimed in claim 6, wherein the moving contact comprises a lever having opposite ends as the first and second parts.

9. The electrical switch as claimed in 1, wherein the first spring comprises a coil spring.

10. The electrical switch as claimed in claim 1, being a normally-closed switch in which, upon release of the operating member, the moving contact is biassed into contact with both of the first and second fixed contacts.

11. The electrical switch as claimed in claim 1, wherein the operating member and the first spring act upon the moving contact along respective, substantially parallel axes that are offset from each other.

12. The electrical switch as claimed in claim 1, wherein the moving contact comprises a lever having opposite ends as the first and second parts.

13. The electrical switch as claimed in claim 1, wherein the operating member includes a second spring engaging the moving contact.

14. The electrical switch as claimed in claim 1, wherein the operating member comprises a pushbutton.

* * * * *